US008366163B1

(12) United States Patent
Harris

(10) Patent No.: US 8,366,163 B1
(45) Date of Patent: Feb. 5, 2013

(54) WHEELCHAIR PULLING DEVICE

(76) Inventor: Everett B. Harris, Tallahassee, FL (US)

( * ) Notice: Subject to any disclaimer, the term of this patent is extended or adjusted under 35 U.S.C. 154(b) by 49 days.

(21) Appl. No.: 13/044,788

(22) Filed: Mar. 10, 2011

(51) Int. Cl.
*A45F 5/00* (2006.01)

(52) U.S. Cl. ..... 294/149; 294/151; 280/304.5

(58) Field of Classification Search ..... 294/146–147, 294/149–157, 165; 119/769, 770, 771, 784, 119/788, 791, 792, 795; 5/923; 128/876; 280/1.5, 280, 292, 293, 304.1, 304.5; 224/148.5–148.7, 250, 426, 563, 584, 675; 297/DIG. 4, 183.6
See application file for complete search history.

(56) References Cited

U.S. PATENT DOCUMENTS 3,682,352 A * 8/1972 Doucette ..... 220/754
4,114,838 A * 9/1978 Knauf ..... 294/157
4,695,071 A 9/1987 Johnston
4,729,576 A 3/1988 Roach
5,335,835 A * 8/1994 Hogan ..... 224/257
5,350,184 A 9/1994 Hull et al.
5,470,093 A 11/1995 Kiser
5,542,730 A * 8/1996 Riesselmann ..... 294/157
D373,750 S 9/1996 Gunderson
5,558,382 A * 9/1996 Wengler ..... 294/157
5,806,730 A * 9/1998 Deno ..... 224/148.6
2009/0012666 A1 1/2009 Simpson et al.

* cited by examiner

*Primary Examiner* — Dean Kramer
*Assistant Examiner* — Stephen Vu

(57) ABSTRACT

A device to facilitate the pulling of a wheelchair comprising a leash having a first end and a second end; a loop disposed on the first end of the leash, the loop is for a person to pull on; a first strap disposed at a 90 degrees angle at the second end of the leash, the first strap having a first distal end wherein a first hook-and-loop component is disposed at the first distal end, the first hook-and-loop can detachably secure to a first complementary hook-and-loop component to wrap around an arm of a wheelchair.

3 Claims, 3 Drawing Sheets

(Cross-sectional View)

(In-use View)

(ISO View)

(Side View)

(Bottom View)

(Cross-sectional View)

(In-use View)

WHEELCHAIR PULLING DEVICE

BACKGROUND OF THE INVENTION

The present invention is directed to a wheelchair pulling device. The wheelchair pulling device of the present invention provides a better way to enable a person such as a caregiver to safely ambulate a patient without compromising their balance by placing the wheelchair within close reach.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
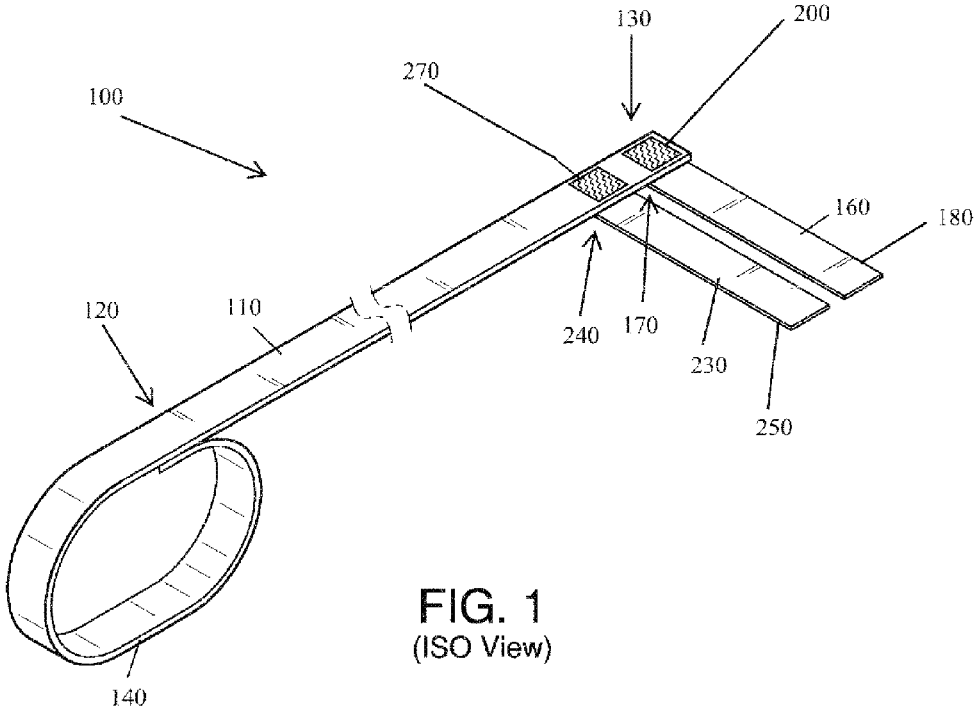
FIG. 1 shows a perspective view of a wheelchair pulling device.
Figure 2:
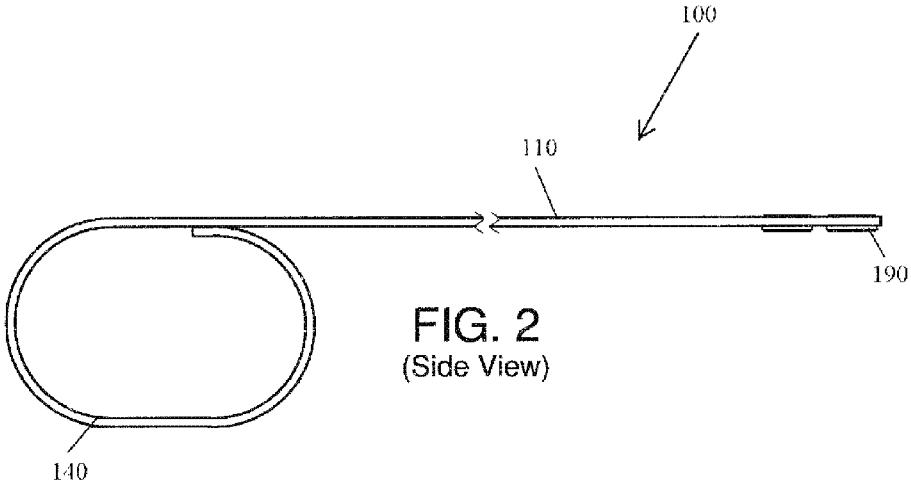
FIG. 2 shows a side view of a wheelchair pulling device.
Figure 3:
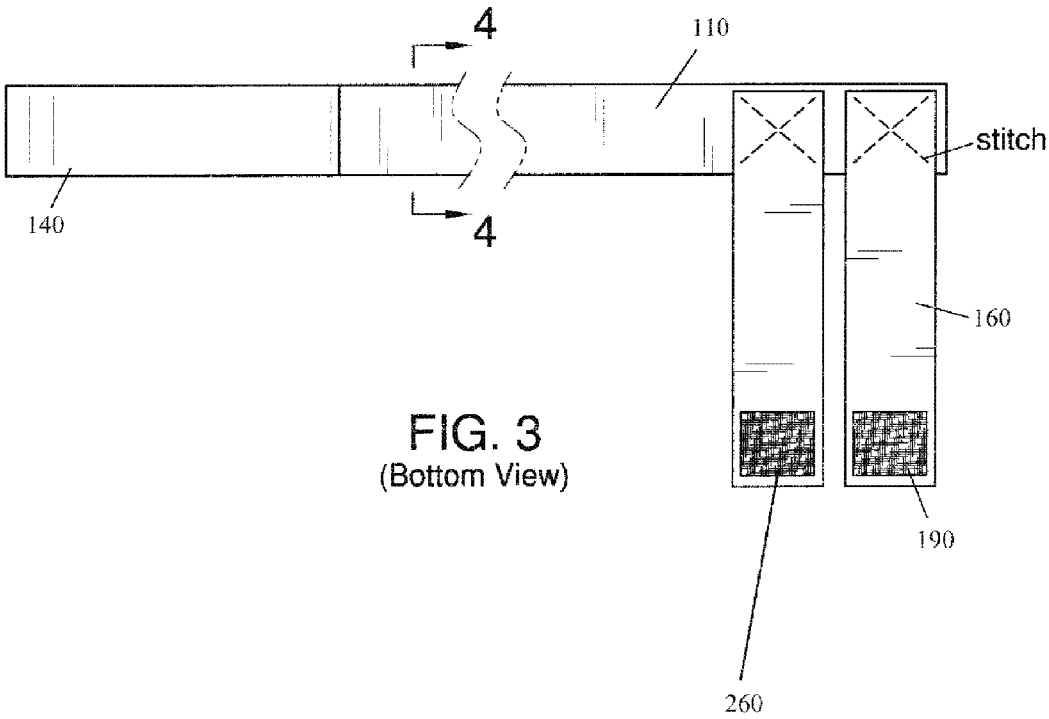
FIG. 3 shows a bottom view of a wheelchair pulling device.
Figure 4:
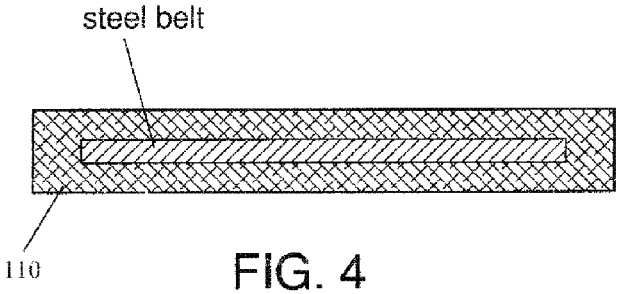
FIG. 4 shows a cross-sectional view of FIG. 3 of a wheelchair pulling device.
Figure 5:
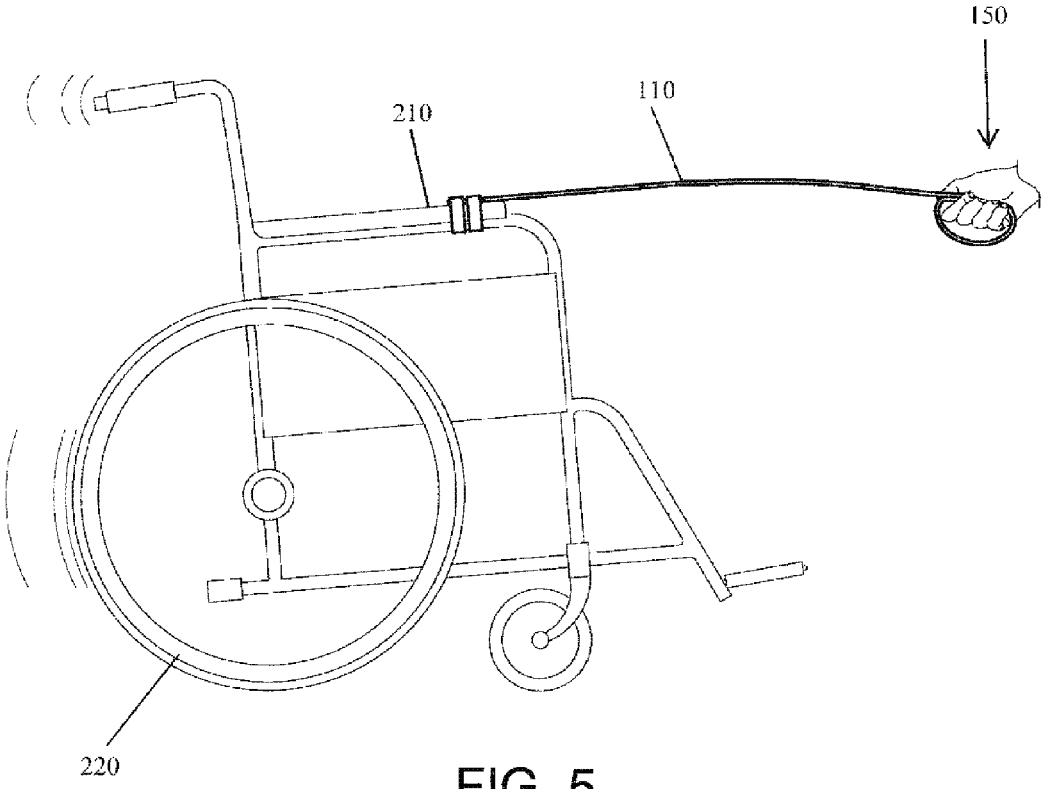
FIG. 5 shows a perspective view of a wheelchair pulling device in use.

Referring now to FIGS. 1-5, the present invention features a device to facilitate the pulling of a wheelchair 100 comprising a leash 110 having a first end 120 and a second end 130. The device further comprises a loop 140 disposed on the first end of the leash, the loop is for a person or caregiver 150 to pull on. In some embodiments, a first strap 160 is disposed at a 90 degrees angle 170 at the second end of the leash. In some embodiments, the first strap having a first distal end 180 wherein a first hook-and-loop component 190 is disposed at the first distal end, the first hook-and-loop can detachably secure to a first complementary hook-and-loop component 200 to wrap around an arm 210 of a wheelchair 220.

The device further comprises a second strap 230 disposed at a 90 degrees angle 240 at the second end of the leash. In some embodiments, the second strap having a second distal end 250 wherein a second hook-and-loop component 260 is disposed at the second distal end, the second hook-and-loop can detachably secure to a second complementary hook-and-loop component 270 to wrap around an arm of a wheelchair. The device will enable the person or caregiver to safely ambulate a patient without compromising their balance by placing the wheelchair within close reach. The device will extend the contact with the wheelchair to the person or caregiver from feet away to inches away. The device allows a person or caregiver to pull the wheelchair while keeping their hands on an ambulating patient. The device would allow a person or caregiver to bring the wheelchair while walking the patient in case the patient may later need the wheelchair. The device could also attach to a person's or caregiver's body or article of clothing such as a belt.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A wheelchair system, the system comprising:

(a) a wheelchair (220) having an arm (210);

(b) a leash (110) having a first end (120) and a second end (130), wherein the leash has a rectangle cross-section shape and encloses a core of rectangle steel belt;

(c) a loop (140) disposed on the first end of the leash, the loop is for a person (150) to pull on;

(d) a first strap (160) disposed at a 90 degrees angle at the second end of the leash, the first strap having a first distal end (180) wherein a first hook-and-loop component (190) is disposed at the first distal end, the first hook-and-loop component can detachably secure to a first complementary hook-and-loop component (200) to wrap around the arm (210) of the wheelchair (220).

2. The system of claim 1 further comprising a second strap (230) disposed at a 90 degrees angle at the second end of the leash, the second strap having a second distal end (250) wherein a second hook-and-loop component (260) is disposed at the second distal end, the second hook-and-loop component can detachably secure to a second complementary hook-and-loop component (270) to wrap around the arm of the wheelchair.

3. A wheelchair system, the system consisting of:

(a) a wheelchair (220) having an arm (210);

(b) a leash (110) having a first end (20) and a second end (130), wherein the leash has a rectangle cross-section shape and encloses a core of rectangle steel belt;

(e) a loop (140) disposed on the first end of the leash, the loop is for a person (150) to pull on;

(f) a first strap (160) disposed at a 90 degrees angle at the second end of the leash, the first strap having a first distal end (180) wherein a first hook-and-loop component (190) is disposed at the first distal end, the first hook-and-loop component can detachably secure to a first complementary hook-and-loop component (200) to wrap around the arm (210) of the wheelchair (220).

* * * * *